US009797057B2

(12) United States Patent
Kruglick

(10) Patent No.: US 9,797,057 B2
(45) Date of Patent: Oct. 24, 2017

(54) MAGNETIC ELECTRO-PLATING

(75) Inventor: Ezekiel Kruglick, Poway, CA (US)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 951 days.

(21) Appl. No.: 12/546,499

(22) Filed: Aug. 24, 2009

(65) Prior Publication Data

US 2011/0042223 A1 Feb. 24, 2011

(51) Int. Cl.
*C25D 3/56* (2006.01)
*C25D 5/00* (2006.01)

(52) U.S. Cl.
CPC ..... *C25D 5/006* (2013.01); *C25D 3/562* (2013.01)

(58) Field of Classification Search
CPC ..... C25D 5/006; C25D 5/024; C25D 5/18; H01F 7/20–7/206
USPC ..... 205/80–315
See application file for complete search history.

(56) References Cited

U.S. PATENT DOCUMENTS 3,880,725 A * 4/1975 Van Raalte et al. ..... 205/95
3,983,519 A * 9/1976 Stadigh ..... B66B 1/50 335/151
4,244,788 A * 1/1981 Faulkner ..... 360/133
4,780,781 A 10/1988 Sano et al.
5,332,487 A * 7/1994 Young et al. ..... 205/80
5,516,418 A * 5/1996 Doss et al. ..... 205/119
5,571,573 A * 11/1996 Shukovsky et al. ..... 427/531
6,228,236 B1 * 5/2001 Rosenstein et al. ..... 204/298.2
6,432,821 B1 * 8/2002 Dubin et al. ..... 438/678
6,468,806 B1 * 10/2002 McFarland ..... B01J 19/0046 205/118
6,511,588 B1 * 1/2003 Kobayashi et al. ..... 205/81
6,755,946 B1 * 6/2004 Patton ..... C25D 17/06 204/224 R
2003/0038034 A1 * 2/2003 Griego et al. ..... 205/89
2003/0095022 A1 * 5/2003 Boynton ..... A61N 2/02 335/299
2003/0183527 A1 * 10/2003 Collins ..... 205/103
2004/0256222 A1 * 12/2004 Griego et al. ..... 204/280
2005/0258044 A1 * 11/2005 Berman ..... C25D 5/00 205/89
2007/0062816 A1 * 3/2007 Chung ..... H05K 3/241 205/89
2007/0089993 A1 * 4/2007 Schwartz et al. ..... 205/133
(Continued)

FOREIGN PATENT DOCUMENTS

JP 60-158611 A 8/1985
JP S60-217603 A * 10/1985 ..... H01F 1/02
(Continued)

OTHER PUBLICATIONS

Hara and Kako, JP S60-217603, Abstract and Partial Translation (1985).*
(Continued)

*Primary Examiner* — James Lin
*Assistant Examiner* — Ho-Sung Chung
(74) *Attorney, Agent, or Firm* — Dorsey & Whitney LLP

(57) ABSTRACT

The present disclosure generally relates to techniques for magnetic electro-plating or electro-deposition. Example methods may include utilizing a magnet during electro-deposition to modify kinetics of deposition of plating material on a substrate.

7 Claims, 7 Drawing Sheets

(56) References Cited

U.S. PATENT DOCUMENTS

| | | | | |
|---|---|---|---|---|
| 2008/0083624 | A1* | 4/2008 | Kim | 205/89 |
| 2008/0202922 | A1* | 8/2008 | Zhong et al. | 204/273 |
| 2009/0061175 | A1 | 3/2009 | Kim | |
| 2009/0065363 | A1* | 3/2009 | Liakopoulos et al. | 205/89 |
| 2010/0006444 | A1 | 1/2010 | Endo et al. | |
| 2010/0038252 | A1* | 2/2010 | Kasuya | 205/89 |

FOREIGN PATENT DOCUMENTS

| | | | | | |
|---|---|---|---|---|---|
| JP | S60-217604 | A | * | 10/1985 | H01F 1/02 |
| JP | 07-054189 | A | | 2/1995 | |
| JP | 09-310200 | A | | 12/1997 | |
| JP | 2002-241990 | A | | 8/2002 | |
| JP | 2003-112042 | A | | 4/2003 | |
| JP | 2005-281797 | | | 10/2005 | |
| JP | 2006-089797 | | | 4/2006 | |

OTHER PUBLICATIONS

Hara and Kako, JP S60-217604, Abstract (1985).*
Oxford Dictionaries, Grid (2015).*
Osada, machin translation, JP 2006-089797 A (2006).*
Itagaki, Masayuki et al., "Partial nickel plating using organic gel electrolyte", Electrochimica Acta, vol. 52, 2007, pp. 6421-6426.
International Search Report and Written Opinion, International Application No. PCT/US2010/046331, Aug. 23, 2010, 9 pages.
Said, R. A. , "Forced convection magnetoelectroplating for enhanced semiconductor metallization", Journal of Vacuum Science & Technology A: Vacuum, Surfaces, and Films, vol. 22, Issue 3, pp. 452-460, May 2004.

* cited by examiner

MAGNETIC ELECTRO-PLATING

BACKGROUND

Electro-plating is a plating process that uses electrical current to reduce cations of a plating material from a solution and coat an object with a thin layer of the material, such as a metal. The process used in electro-plating is called electro-deposition. Electro-plating and electro-deposition may be referred to interchangeably herein. Electro-plating typically uses material indiscriminately from a source, requiring wasteful concentrations of plating material in the solution to maintain diffusion based electro-plating concentrations.

BRIEF DESCRIPTION OF THE FIGURES

The foregoing and other features of the present disclosure will become more fully apparent form the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings.

In the drawings.

DETAILED DESCRIPTION

Figure 1:
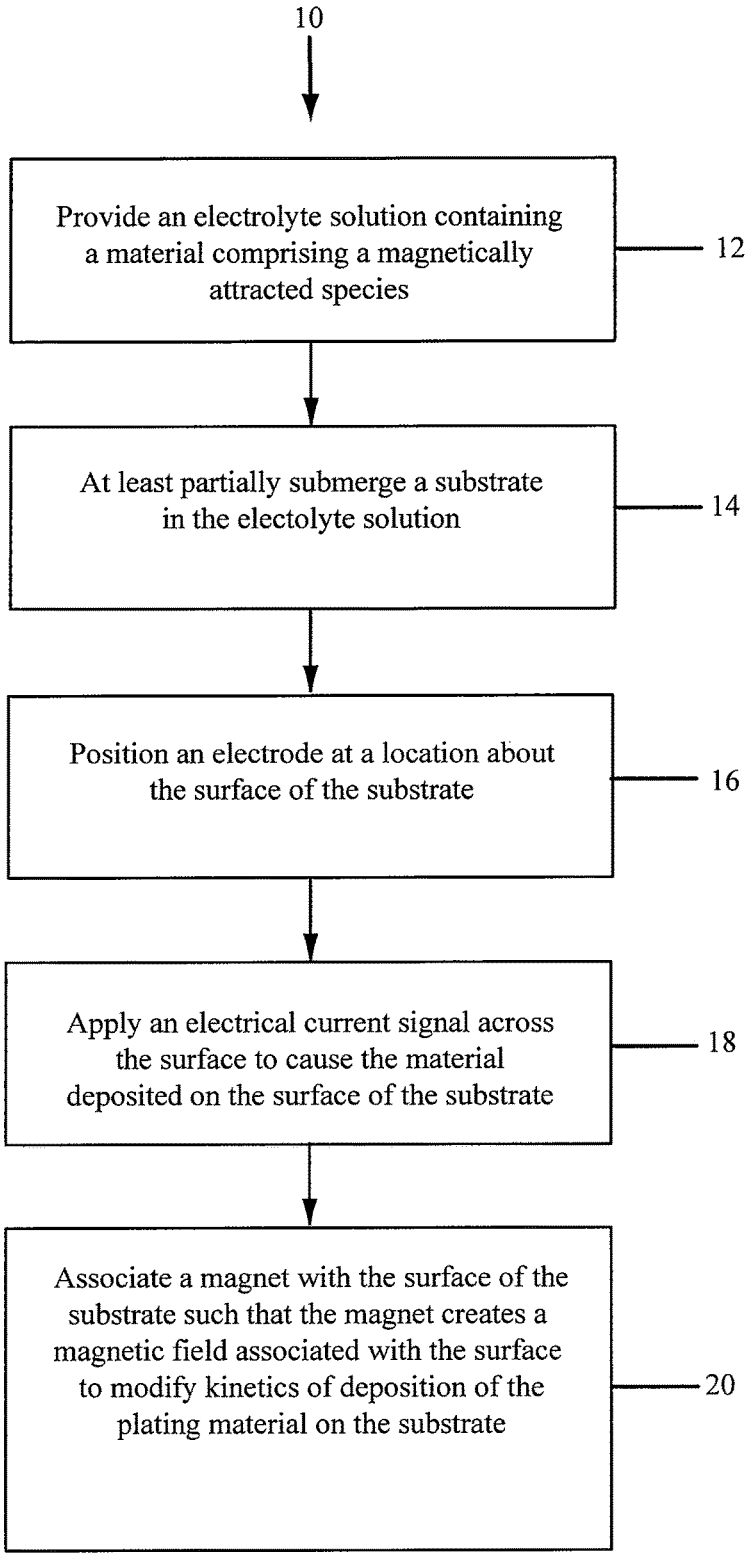
FIG. 1 illustrates a method of electro-deposition of a material on a substrate.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, may be arranged, substituted, combined, separated, and designed in a wide variety of different configurations, all of which are explicitly contemplated herein.

This disclosure is drawn, inter alia, to methods, apparatus, computer programs and systems generally related to magnetic electro-plating of a plating material on a surface of a substrate. Example methods may include utilizing a magnet during electro-deposition to modify deposition kinetics. Electro-deposition is an electrochemical process by which metal or other materials (referred to herein as the plating material(s)) are deposited on a substrate by passing a current through an electrolyte solution containing the plating material. Replacing or augmenting diffusion with magnet force may facilitate usage of source chemicals (plating material) in the solution. Such approach may reduce material needs and may offer speed and control to a plating solution. Accordingly, various methods and systems for electro-deposition of a plating material are generally disclosed. Materials may be electro-deposited on a substrate relatively simply and effectively. In some examples, constant direct current may be used to plate a thin layer on a substrate.

FIG. 1 illustrates a method 10 of electro-deposition of a material on a substrate in accordance with at least some examples of the present disclosure. Method 10 may include one or more functional operations as illustrated by operations 12, 14, 16, 18 and/or 20. Processing may begin at operation 12, where an electrolyte solution containing a material comprising a magnetically attracted species may be provided. At operation 14, a substrate may be at least partially submerged in the electrolyte solution. At operation 16, an electrode may be positioned at a location about the surface of the substrate. At operation 18, an electrical current may be applied across the surface to cause the material to be deposited on the substrate. At operation 20, a magnet may be associated with the surface of the substrate such that the magnet creates a magnetic field associated with the surface to modify kinetics of deposition of the plating material on the substrate. In some examples, a current may not be applied across the substrate and deposition may occur on the basis of magnetic force.

More specifically, an electrolyte solution may be provided containing the plating material to be deposited. Generally, the plating material may be a material comprising a magnetically attracted species such as a ferrous compound, a permalloy (a nickel iron magnetic alloy, for example having approximately 20% iron and 80% nickel), a chrome alloy, and the like. For example, the plating material may be a cobalt-nickel-iron (Co—Ni—Fe) alloy. The electrolyte solution, comprising the plating material in solution, may be provided in a tank suitable for receiving the substrate. The substrate may be placed in the electrolyte solution. The substrate may be fully or partially submerged. The magnet may be positioned such that the magnetic field is associated with the surface of the substrate to enhance kinetics of deposition of the plating material thereon. For example, the magnet may be placed opposite or near the surface to receive the material to pull the plating material to the surface. Alternatively, the magnet may be positioned such that the surface of the substrate faces the magnet, thereby slowing kinetics of deposition of the plating material thereon. The electrode(s) may be associated with the substrate, such as by contacting the electrodes to the substrate, and electrical current applied.

In some examples, the substrate may act as the cathode. As the current is applied and/or the magnetic field activated, positive metal ions from the solution may be deposited on the substrate. The magnet may be a conventional magnet, may be an electromagnet, or may be a magnet designed for magnetic electro-deposition. Suitable electromagnets include, for example, current coils. Suitable conventional magnets may be permanent magnets or temporary magnets. Suitable permanent magnets may include, for example, neodymium iron boron (NdFeB or NIB) magnets, samarium cobalt (SmCo) magnets, alnico magnets, or ceramic or ferrite magnets. In some examples, the magnet may be a current coil. Generally, the magnetic field may be at a strength above the magnitude of the earth's magnetic field.

In some examples, the magnet may be positioned to modify deposition kinetics, such as to enhance deposition kinetics. This may be done over an entire surface of the substrate or may be done in particular positions. In one example, the magnet may enhance deposition over substantially the entire surface of the substrate, such as by providing a magnet having a size substantially correlating to a size of the surface of the substrate. In another example, one or more magnets may be positioned at particular locations of the substrate to preferentially pull plating material to those locations. In one example, one or more current coils may be associated with the substrate and a power source or signal generator associated with those current coils. By turning on certain coils, thereby activating the magnetic field of the coil, a bit map may be written on the substrate. Accordingly, thickness of the electroplated material may be varied over a surface through the use of selectively positioned magnets.

In some examples, the magnet may be positioned to slow deposition kinetics. In some situations, slowing down movement of the plating material may result in a smoother deposited surface.

Replacing or augmenting diffusion with magnetic force facilitates usage of material in the supply. More specifically, the magnetic field may reduce waste of plating material in the electrolyte solution. The described approach may reduce electrolyte needs and may offer speed and control to a plating bath. In some examples, the anode may be sacrificial and may supply replenishment for deposited ions from the electrolyte solution. In other examples, the anode may be formed from a non-consumable material and the solution may be replenished.

Figure 2:
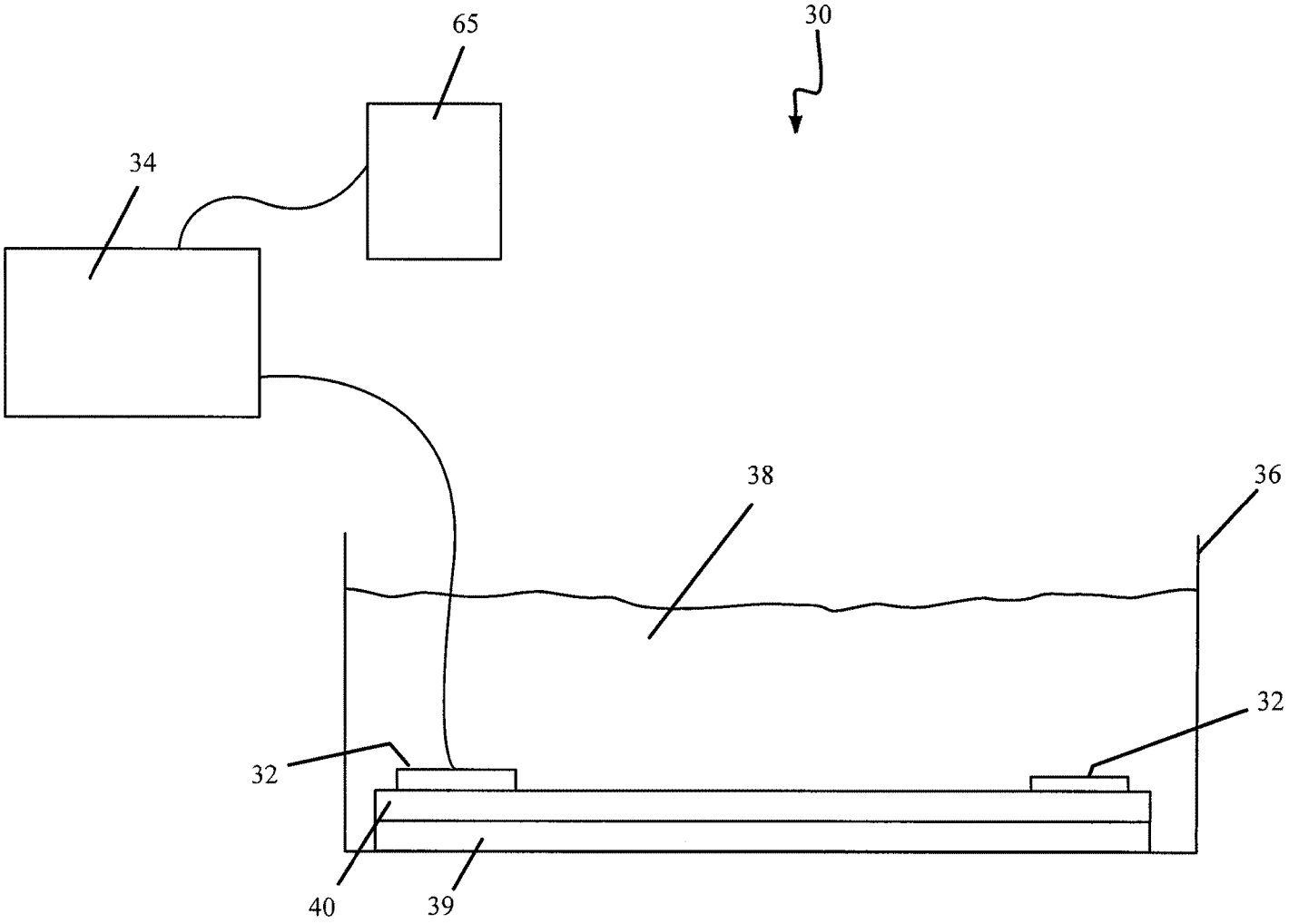
FIG. 2 illustrates an electro-plating system including a magnet to enhance deposition kinetics.

FIG. 2 illustrates an electro-plating system including a magnet to enhance deposition kinetics in accordance with at least some examples of the present disclosure. As shown, the electro-plating system 30 may include one or more electrodes 32 (including, for example, an anode), a signal generator or power source 34, a tank 36 (also referred to as a plating bath), an electrolyte solution 38, one or more magnets 39, a substrate 40, and/or a processor 65.

The tank 36 may be made of a generally non-metallic material. In various examples, the non-metallic material may be plastic, glass, ceramic, or other non-metallic material. The electrolyte solution 38 may be provided in the tank 36 and may contain the plating material, a magnetically active material, in an ionic form. For example, the electrolyte solution 38 may comprise analytical reagent Co—Ni—FE and Millipore water. In some examples, the magnet 39 may be positioned in the solution 38. As shown, the magnet may have a size substantially correlating to a size of the substrate. The magnet may be positioned underneath the substrate, or opposite the surface to receive the material, where the magnet is positioned so that it may enhance deposition kinetics over substantially the entire surface of the substrate. The signal generator 34 may be configured to apply a current signal to the electrode 32. A frequency modulator (not shown) or a pulse modulator (not shown) may be associated with the signal generator or power source 34. One or more devices for controlling temperature may be provided (not shown), such as a Peltier element and temperature selector. By reducing temperature, the electrolyte solution 38 may be solidified.

Figure 3:
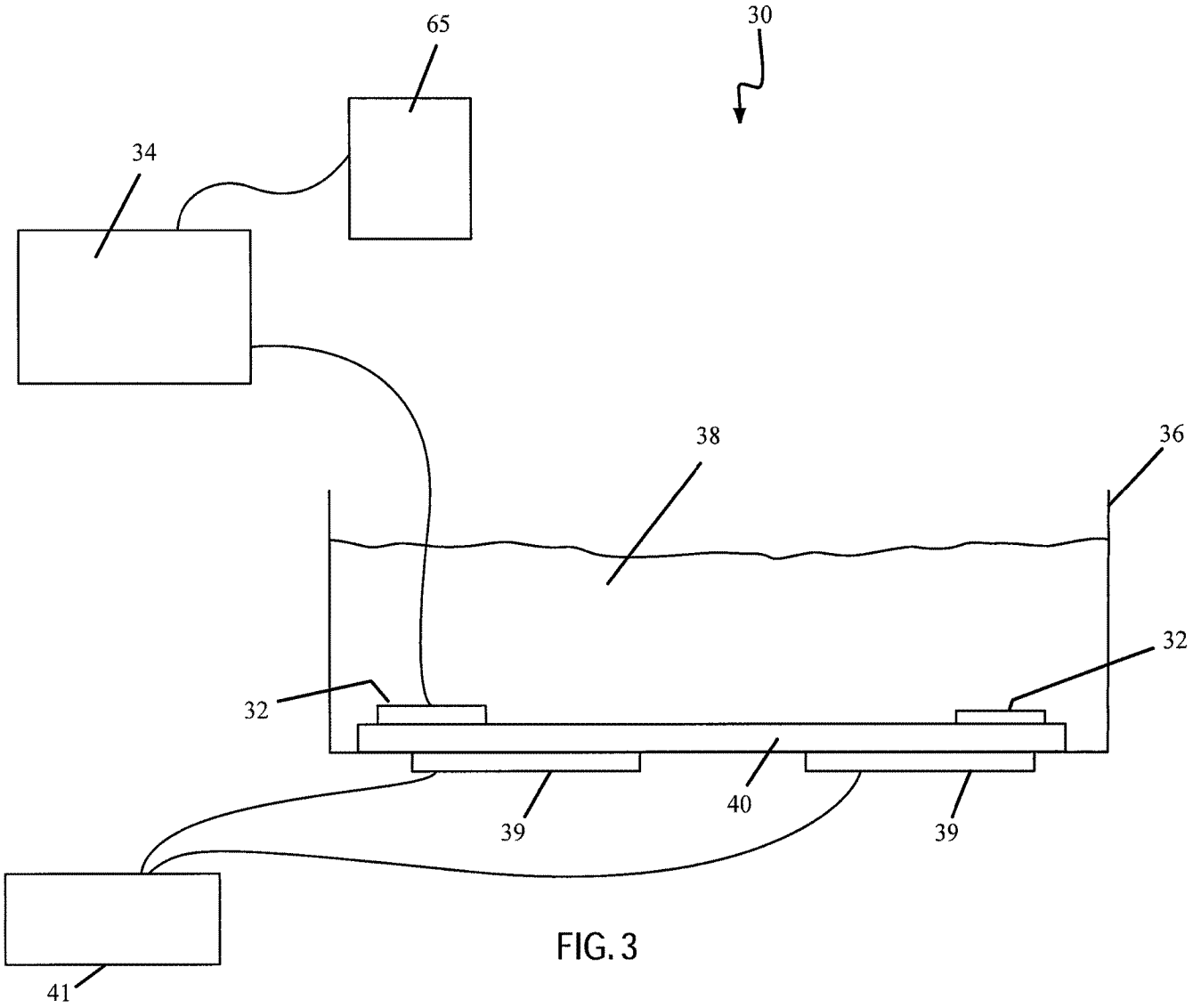
FIG. 3 illustrates an electro-plating system including two current coil magnets to enhance deposition kinetics.

FIG. 3 illustrates an electro-plating system including two current coil magnets to enhance deposition kinetics in accordance with some examples. As shown, the electro-plating system 30 may include one or more electrodes 32 (including, for example, an anode), a signal generator or power source 34, a tank 36 (also referred to as a plating bath), an electrolyte solution 38, one or more magnets 39, a substrate 40, a current generator or power source 41, and a processor 65. In some examples, the magnets 39 may comprise electromagnets such as current coils. The tank 36 may be made of a generally non-metallic material. In various examples, the non-metallic material may be plastic, glass, ceramic, or other non-metallic material. The electrolyte solution 38 may be provided in the tank 36 and may contain the plating material, a magnetically active material, in an ionic form. In some examples, the magnets 39 may be positioned outside of the tank 36. The current generator or power source 41 may be configured to drive the magnets 39. The magnets 39 may be positioned such that the first magnet creates a first magnetic field associated with the surface of the substrate and the second magnet creates a second magnetic field associated with the surface of the substrate and the first and second magnetic fields interact to create a desired pattern. For example, such that, upon powering of the magnets 39 on and off, deposition causes a pattern related to a bit map that may be provided in a computer system to be written on the surface of the substrate 40. More specifically, an array of magnets positioned in a grid or other pattern may be turned on and off to cause different amounts of plating in different locations. The processor 65 may be coupled (directly or indirectly) to the power source 41, the magnets 39, and/or to the electrodes 32. The signal generator 34 may be configured to apply a current signal to the electrode 32. A frequency modulator (not shown) or a pulse modulator (not shown) may be associated with the signal generator or power source 34. One or more devices for controlling temperature may be provided (not shown), such as a Peltier element and temperature selector. By reducing temperature, the electrolyte solution 38 may be solidified.

Figure 4:
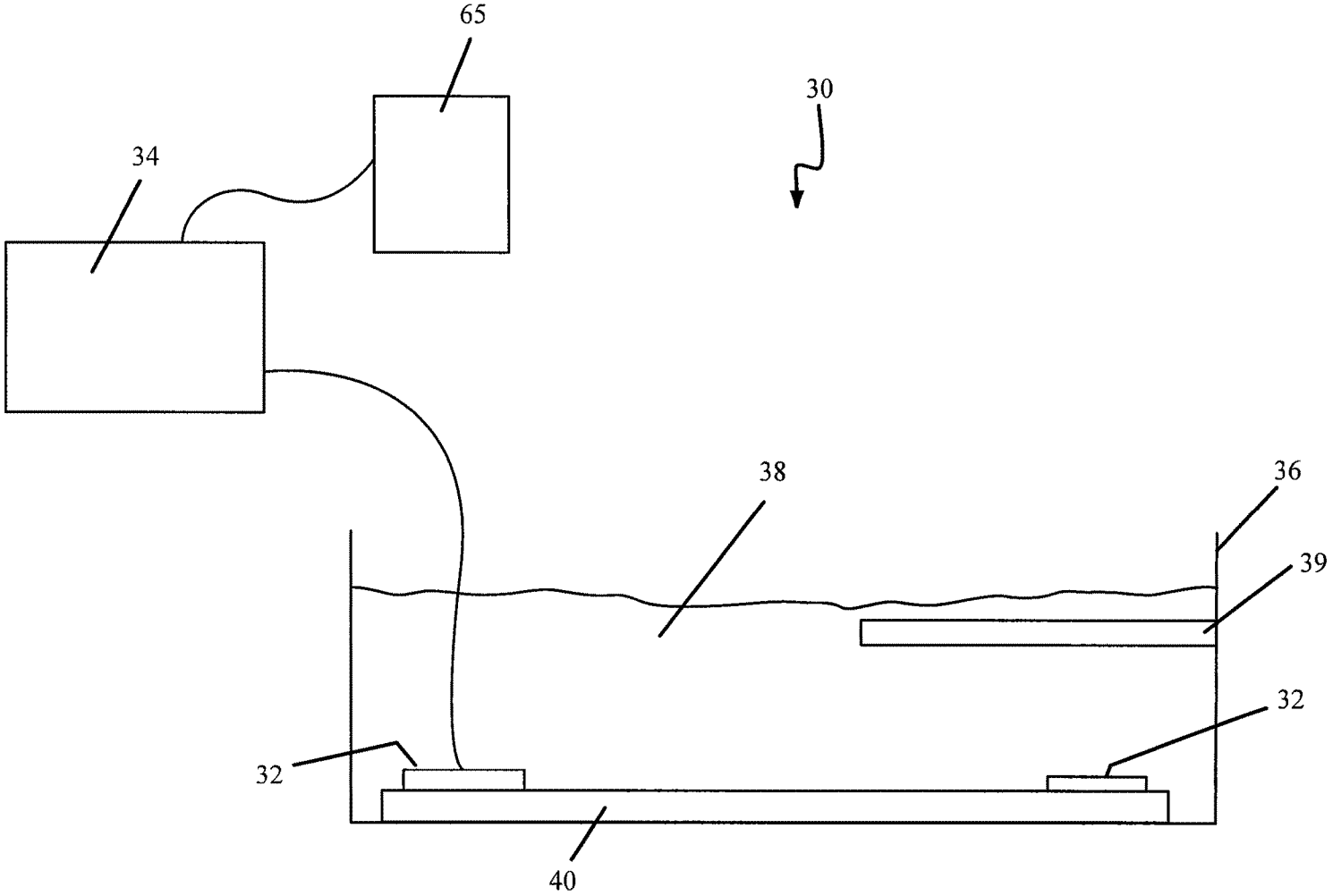
FIG. 4 illustrates an electro-plating system including a magnet to slow deposition kinetics.

FIG. 4 illustrates an electro-plating system including a magnet to slow deposition kinetics in accordance with at least some embodiments of the present disclosure. As shown, the electro-plating system 30 may include one or more electrodes 32 (including, for example, an anode), a signal generator or power source 34, a tank 36 (also referred to as a plating bath), an electrolyte solution 38, one or more magnets 39, a substrate 40, and/or a processor 65. The tank 36 may be made of a generally non-metallic material. In various examples, the non-metallic material may be plastic, glass, ceramic, or other non-metallic material. The electrolyte solution 38 may be provided in the tank 36 and may contain the plating material, a magnetically active material, in an ionic form. In some examples, the magnet 39 may be positioned in the solution 38. As shown, the magnet 39 may be positioned such that the surface of the substrate 40 faces the magnet 39. Thus, the magnet 39 may be positioned to slow kinetics of deposition of the plating material on the surface of the substrate 40. The signal generator 34 may be configured to apply a current signal to the electrode 32. A frequency modulator (not shown) or a pulse modulator (not shown) may be associated with the signal generator or power source 34. One or more devices for controlling temperature may be provided (not shown), such as a Peltier element and temperature selector. By reducing temperature, the electrolyte solution 38 may be solidified.

Figure 5:
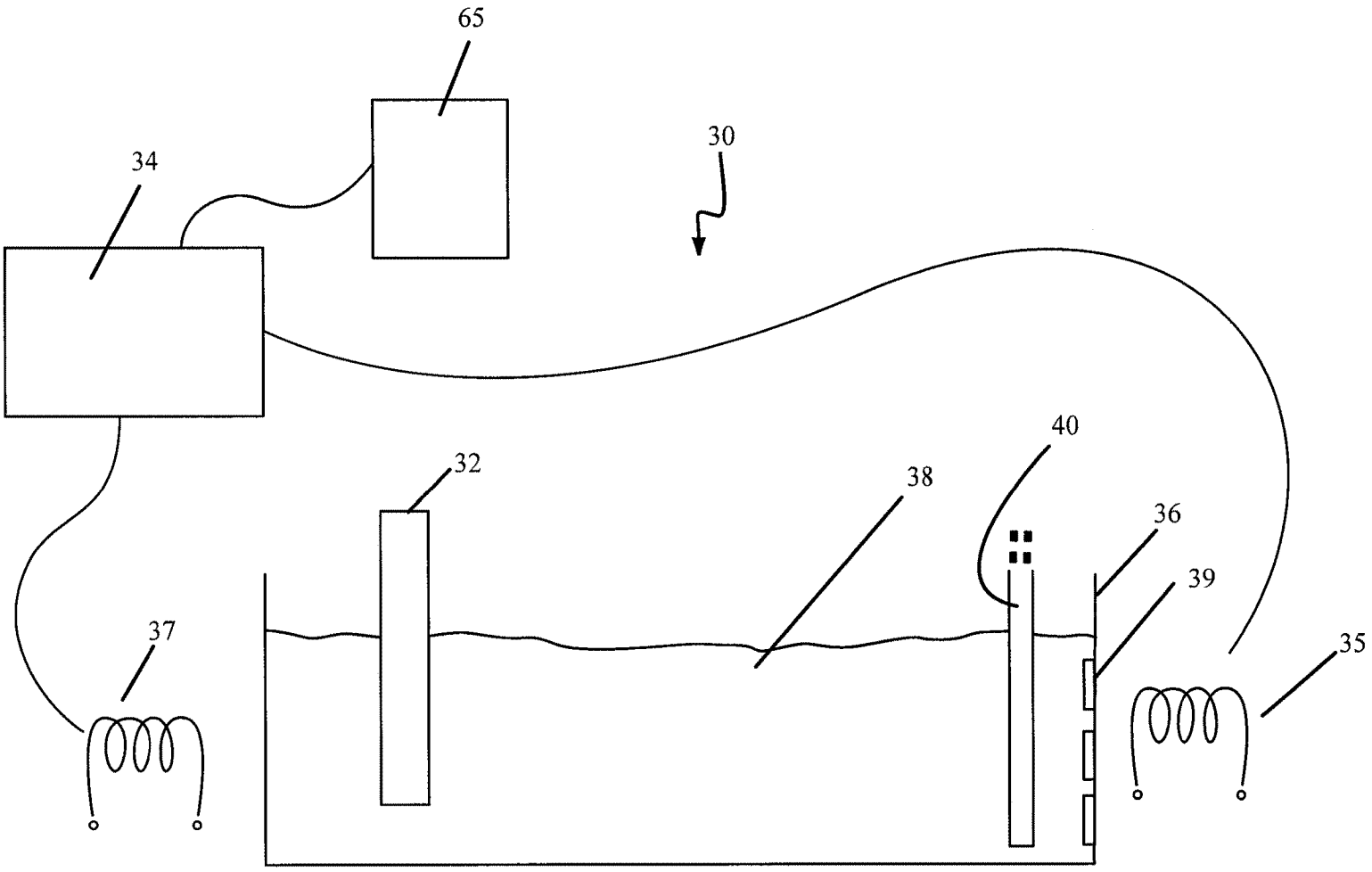
FIG. 5 illustrates an electro-plating system including permanent magnets and an electromagnet to enhance deposition kinetics as well as an electromagnet to slow deposition kinetics.

FIG. 5 illustrates an electro-plating system including permanent magnets and an electromagnet to enhance deposition kinetics as well as an electromagnet to slow deposition kinetics in accordance with at least some embodiments of the present disclosure. As shown, the electro-plating system 30 may include one or more electrodes 32 (including, for example, an anode), a signal generator or power source 34, a tank 36 (also referred to as a plating bath), an electrolyte solution 38, electromagnets 35, 37, and 39, a substrate 40, and/or a processor 65. The tank 36 may be made of a generally non-metallic material. In various examples, the non-metallic material may be plastic, glass, ceramic, or other non-metallic material. The electrolyte solution 38 may be provided in the tank 36 and may contain the plating material, a magnetically active material, in an ionic form. The magnets 35, 37, 39 may be positioned to enhance or to slow deposition kinetics. In the example shown, a plurality of permanent magnets 39 are positioned underneath the substrate, or opposite the surface to receive the material, such that the magnets 39 enhance deposition kinetics. A first electromagnet 35 may be positioned opposite the surface of the substrate to receive the material and outside of the tank, such that the magnet 35 enhances deposition kinetics. A second electromagnet 37 may be provided outside of the tank and in a position such that the surface of the substrate to be coated faces the magnet 39, such that the magnet 37 slows deposition kinetics. The electromagnets 35, 37 may be alternately turned on to speed up and slow down deposition. For example, the second electromagnet 37 may be turned on for slow plating for adhesion and then turned off, followed by the first electromagnet 35 being turned on for fast plating for volume and efficiency and then turned off, followed by the second electromagnet 37 being turned on for slow plating for surface finish. The signal generator 34 may be configured to apply a current signal to the electrode 32. A frequency modulator (not shown) or a pulse modulator (not shown) may be associated with the signal generator or power source 34. One or more devices for controlling temperature may be provided (not shown), such as a Peltier element and temperature selector. By reducing temperature, the electrolyte solution 38 may be solidified.

With reference to FIGS. 2-5, for depositing a material, a substrate 40 may be placed in the electrolyte solution 38. It is to be appreciated that the orientation of the electrode with respect to the substrate may be any suitable contact orientation, including laying of the electrode on the substrate. In some examples, more than one magnet may be provided. In some examples, the magnet may be approximately 1 mm or smaller.

The electrode(s) may be formed of any suitable material. Generally, the electrode may be formed of a material suitable for machining and, in some examples, micro-machining. Thus, for example, the electrode may be formed of one or more materials including nickel (Ni), copper (Cu), or graphite. Electrodes formed of a material that may be depleted by the electrolyte solution may not be suitable for reuse while electrodes formed from a material that is not depleted by the electrolyte solution may be suitable for reuse. In alternative examples, the electrodes may be formed of a material suitable for reuse.

Any suitable material may be used as a substrate so long as it may be electro-plated upon. For example, a piezo-electric substrate such as aluminum nitrate substrate material may be used. For electronics, a thin layer of gold may be provided over the substrate. Common substrate materials for electro-plating may include piezo-electric materials, silicon on insulators (SOI, such as silicon on oxides) materials, oxide materials, and polymer materials.

In some examples, the substrate may be prepared to enhance suitability for electro-deposition. For example, the substrate may be cleaned, may be coated with a hydrophilic coating, may be coated with a conductive coating such as gold, coated with an electro-plating seed layer, or otherwise prepared. Further, the substrate may be sized and shaped for final use prior to or after electro-deposition. Thus, in some examples, the substrate may be cut or subdivided into chip sizes before electro-deposition of the plating material. In other examples, the substrate may be provided in a monolithic piece, plating material may be electro-deposited thereon, and the substrate may be cut or subdivided into sizes for use thereafter.

Any suitable electrolyte solution may be used. Generally, the electrolyte solution may contain one or more dissolved magnetically attracted species as well as other ions that permit the flow of electricity. The dissolved magnetically attracted species comprises the plating material to be deposited on the substrate. Generally, the plating material may be a material comprising a magnetically attracted species such as ferrous compounds, permalloy, chrome alloys, and the like.

In some examples, systems and methods as described herein may further include a computing system (not shown). The computer system may be arranged to drive the signal generator or power source 34 and may be used to control a signal level, a frequency, a period, a pulse duration, a duty cycle, an exposure time, or some other characteristic of the applied current signal. A varied frequency may in some examples increase evenness of deposition. In one particular example, a processor 65 may be provided for controlling a frequency and/or a signal level of the current signal provided by the signal generator or signal generator 34. The computer system may further be arranged to drive the electromagnets such as to turn the electromagnets on or off to control plating thicknesses.

Figure 6:
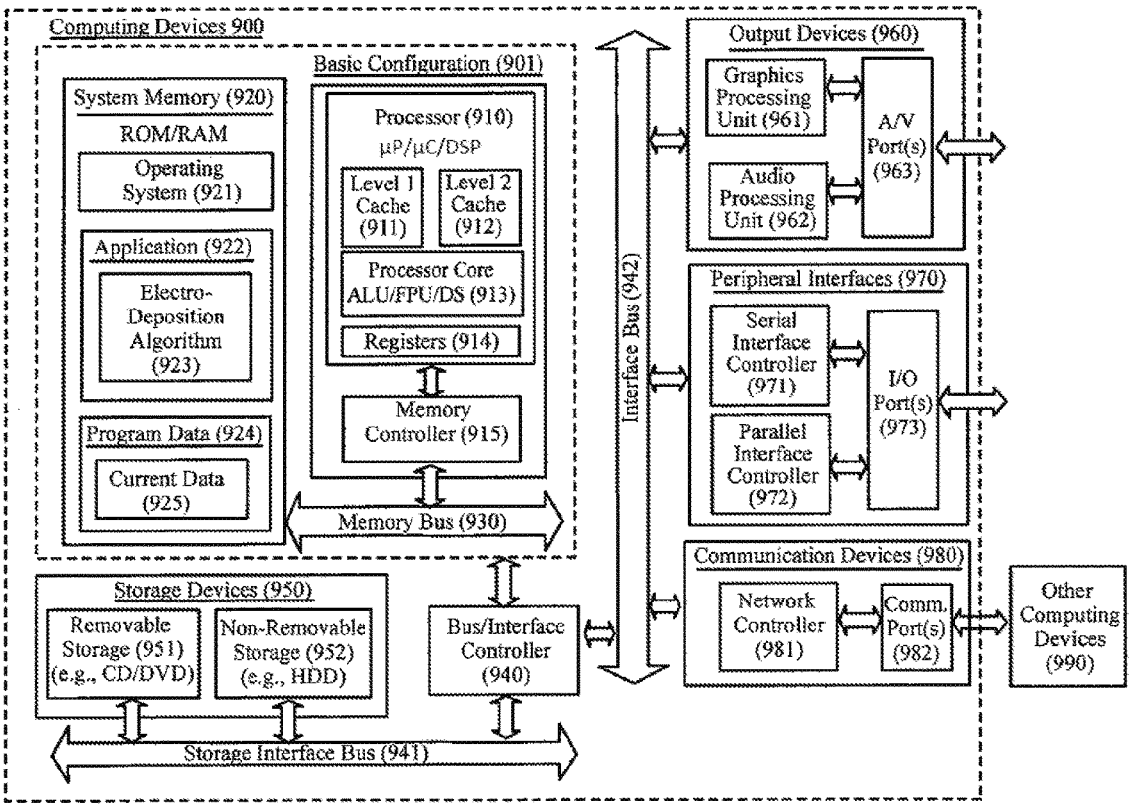
FIG. 6 is a block diagram illustrating an example computing device that is arranged for electro-deposition.

FIG. 6 is a block diagram illustrating an example computing device 900 that is arranged for electro-deposition in accordance with at least some examples of the present disclosure. In a very basic configuration 901, computing device 900 typically may include one or more processors 910 and system memory 920. A memory bus 930 may be used for communicating between the processor 910 and the system memory 920.

Depending on the desired configuration, processor 910 may be of any type including but not limited to a microprocessor (μP), a microcontroller (μC), a digital signal processor (DSP), or any combination thereof. Processor 910 may include one or more levels of caching, such as a level one cache 911 and a level two cache 912, a processor core 913, and registers 914. An example processor core 913 may include an arithmetic logic unit (ALU), a floating point unit (FPU), a digital signal processing core (DSP Core), or any combination thereof. An example memory controller 915 may also be used with the processor 910, or in some implementations, the memory controller 915 may be an internal part of the processor 910.

Depending on the desired configuration, the system memory 920 may be of any type including but not limited to volatile memory (such as RAM), non-volatile memory (such as ROM, flash memory, etc.) or any combination thereof. System memory 920 may include an operating system 921, one or more applications 922, and program data 924. Application 922 may include an electro-deposition algorithm 923 that may be arranged to generate a selected frequency or other characteristics of the applied signal during deposition. Program Data 924 may include current data 925 (or other data indicative of characteristics of the applied signal) that may be useful for determining a frequency corresponding to a specific periodicity of the applied signal during deposition. In some embodiments, application 922 may be arranged to operate with program data 924 on an operating system 921 such that current may be supplied to electrodes to cause electro-deposition of materials in accordance with described methods found herein. This described basic configuration is illustrated in FIG. 5 by those components within dashed line 901.

Computing device 900 may have additional features or functionality, and additional interfaces to facilitate communications between the basic configuration 901 and any required devices and interfaces. For example, a bus/interface controller 940 may be used to facilitate communications between the basic configuration 901 and one or more data storage devices 950 via a storage interface bus 941. The data storage devices 950 may be removable storage devices 951, non-removable storage devices 952, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 920, removable storage 951 and non-removable storage 952 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 900. Any such computer storage media may be part of device 900.

Computing device 900 may also include an interface bus 942 for facilitating communication from various interface devices (e.g., output interfaces, peripheral interfaces, and communication interfaces) to the basic configuration 901 via the bus/interface controller 940. Example output devices 960 include a graphics processing unit 961 and an audio processing unit 962, which may be configured to communicate to various external devices such as a display or speakers via one or more A/V ports 963. Example peripheral interfaces 970 include a serial interface controller 971 or a parallel interface controller 972, which may be configured to communicate with external devices such as input devices (e.g., keyboard, mouse, pen, voice input device, touch input device, etc.) or other peripheral devices (e.g., printer, scanner, etc.) via one or more I/O ports 973. An example communication device 980 includes a network controller 981, which may be arranged to facilitate communications with one or more other computing devices 990 over a network communication link via one or more communication ports 982.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 900 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 900 may also be implemented as a personal computer including both laptop computer and non-laptop computer configurations.

Figure 7:
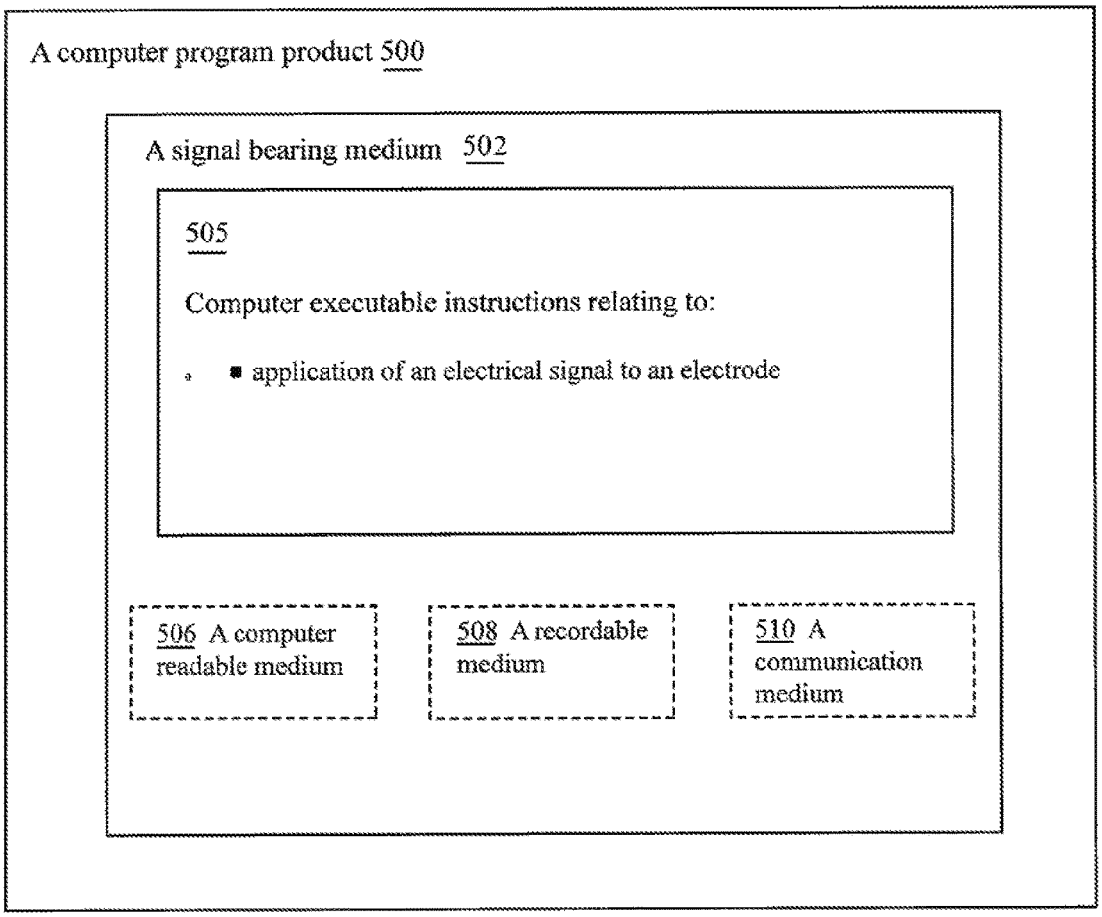
FIG. 7 illustrates a block diagram of an example computer program product; all arranged in accordance with at least some embodiments of the present disclosure.

FIG. 7 illustrates a block diagram of an example computer program product 500 arranged in accordance with at least some examples of the present disclosure. In some examples, as shown in FIG. 7, computer program product 500 may include a signal bearing medium 502 that may also include computer executable instructions 505. Computer executable instructions 505 may be arranged to provide instructions for electro-deposition. Such instructions may include, for example, instructions relating to application of an electrical signal to an electrode or for controlling electromagnets. Generally, the computer executable instructions may include instructions for performing any steps of the method for magnetic electro-deposition described herein. For example, the computer executable instructions may relate to one or more of selecting or adjusting characteristics of an electrical signal, application of the electrical signal to an electrode using the selected or adjusted characteristics, and turning on and off electromagnets.

Also depicted in FIG. 7, in some examples, computer product 500 may include one or more of a computer readable medium 506, a recordable medium 508 and a communications medium 510. The dotted boxes around these elements may depict different types of mediums that may be included within, but not limited to, signal bearing medium 502. These types of mediums may distribute computer executable instructions 505 to be executed by computer devices including processors, logic and/or other facility for executing such instructions. Computer readable medium 506 and recordable medium 508 may include, but are not limited to, a flexible disk, a hard disk drive (HDD), a Compact Disc (CD), a Digital Video Disk (DVD), a digital tape, a computer memory, etc. Communications medium 510 may include, but is not limited to, a digital and/or an analog communication medium (e.g., a fiber optic cable, a waveguide, a wired communication link, a wireless communication link, etc.).

The present disclosure is not to be limited in terms of the particular embodiments described in this application, which are intended as illustrations of various aspects. Many modifications and variations may be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which may, of course, vary. It is also to be understood that the terminology used herein is for the purpose of describing particular embodiments only, and is not intended to be limiting.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range may be easily recognized as sufficiently describing and enabling the same range being broken down into at least equal halves, thirds, quarters, fifths, tenths, etc. As a non-limiting example, each range discussed herein may be readily broken down into a lower third, middle third and upper third, etc. As will also be understood by one skilled in the art all language such as "up to," "at least," "greater than," "less than," and the like include the number recited and refer to ranges which may be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method for electro-depositing a plating material on a surface of a substrate, the method comprising:

at least partially submerging the substrate in an electrolyte solution including the plating material, wherein the plating material includes ferrous species, and wherein the substrate includes a first surface on which the plating material is to be deposited;

positioning an electrode to face the first surface of the substrate;

positioning one or more permanent magnets to face a second surface of the substrate, the second surface being opposite to the first surface;

positioning a first electromagnet to face the second surface of the substrate, wherein the first electromagnet, by virtue of its position, enhances kinetics of deposition of the plating material on the first surface of the substrate;

positioning a second electromagnet to face the first surface of the substrate, wherein the second electromagnet, by virtue of its position, reduces the kinetics of deposition of the plating material on the first surface of the substrate;

applying an electrical signal to the electrode to cause the plating material to deposit on the first surface of the substrate, wherein the electrical signal varies over time in a pre-determined pattern, and wherein the pre-determined pattern over time is controlled by a signal generator; and alternately turning on the first electromagnet and the second electromagnet to speed up and slow down the deposition of the plating material on the first surface of the substrate.

2. The method of claim 1, wherein alternately turning on the first electromagnet and the second electromagnet comprises turning on the second electromagnet for adhesion of the plating material on the first surface of the substrate, followed by turning off the second electromagnet and turning on the first electromagnet, followed by turning off the first electromagnet and turning on the second electromagnet for surface finishing of the deposited plating material.

3. The method of claim 1, wherein each magnet of the one or more permanent magnets is 1 mm in diameter.

4. The method of claim 1, further comprising preparing the substrate before at least partially submerging material the substrate in the electrolyte solution.

5. The method of claim 4, wherein preparing the substrate includes at least one of cleaning the substrate, coating the substrate with a conductive coating, coating the substrate with a hydrophilic coating, or coating the substrate with an electro-plating seed layer.

6. A method for electro-depositing a plating material on a surface of a substrate, the method comprising:

at least partially submerging the substrate in an electrolyte solution including the plating material, wherein the plating material includes ferrous species, and wherein the substrate includes a first surface on which the plating material is to be deposited, and a second surface opposite to the first surface;

positioning an electrode to face the first surface of the substrate;

positioning one or more permanent magnets underneath the substrate;

positioning a first electromagnet to face the second surface of the substrate, wherein the first electromagnet, by virtue of its position, enhances kinetics of deposition of the plating material on the first surface of the substrate;

positioning a second electromagnet to face the first surface of the substrate, wherein the second electromagnet, by virtue of its position, reduces the kinetics of deposition of the plating material on the first surface of the substrate;

applying an electrical signal to the electrode to cause the plating material to deposit on the surface of the substrate; and alternately turning on the first electromagnet and the second electromagnet to speed up and slow down the deposition of the plating material on the first surface of the substrate.

7. The method of claim 6, wherein alternately turning on the first electromagnet and the second electromagnet comprises turning on the second electromagnet for adhesion of the plating material on the first surface of the substrate, followed by turning off the second electromagnet and turning on the first electromagnet, followed by turning off the first electromagnet and turning on the second electromagnet for surface finishing of the deposited plating material.

* * * * *